US007621403B2

(12) United States Patent
Althoff et al.

(10) Patent No.: US 7,621,403 B2
(45) Date of Patent: Nov. 24, 2009

(54) LIQUID COSMETIC PRODUCT RETAIL UNIT

(75) Inventors: Charles Peter Althoff, Cleveland Hts., OH (US); Jason Tilk, Cleveland Hts., OH (US); John William Nottingham, Bratenahl, OH (US); John Richard Nottingham, Bratenahl, OH (US); John Wilford Spirk, Jr., Gates Mills, OH (US); Jay Tapper, Beachwood, OH (US); Patrick Coyne, Shaker Heights, OH (US); Ian Stuart Midgley, Leeds (GB); Dean Michael Limb, Leeds (GB)

(73) Assignee: Conopco, Inc., Englewood Cliffs, NJ (US)

( * ) Notice: Subject to any disclaimer, the term of this patent is extended or adjusted under 35 U.S.C. 154(b) by 181 days.

(21) Appl. No.: 11/625,961

(22) Filed: Jan. 23, 2007

(65) Prior Publication Data

US 2008/0173562 A1 Jul. 24, 2008

(51) Int. Cl.
*B65D 69/00* (2006.01)

(52) U.S. Cl. ..... 206/581; 206/443; 206/485; 206/497; 206/509; 220/8

(58) Field of Classification Search ..... 206/385, 206/581, 443, 485, 486, 497, 526, 509, 511, 206/823; 132/314; 220/4.21, 4.24, 4.26, 220/4.27, 8

See application file for complete search history.

(56) References Cited

U.S. PATENT DOCUMENTS

| | | | | | |
|---|---|---|---|---|---|
| 105,269 | A * | 7/1870 | Spencer | 206/769 |
| 2,892,540 | A | 6/1959 | Tupper | 206/65 |
| 3,679,405 | A | 7/1972 | Makino et al. | 96/1.5 |
| 4,819,832 | A * | 4/1989 | Lawson | 222/153.13 |
| 5,358,101 | A * | 10/1994 | Lombardi | 206/581 |
| 5,392,945 | A * | 2/1995 | Syrek | 206/509 |
| 5,979,643 | A | 11/1999 | Blonder et al. | 206/63.5 |
| 6,016,916 | A * | 1/2000 | Ortner | 206/581 |
| 6,440,175 | B1 * | 8/2002 | Stanley, III | 206/581 |
| 6,644,472 | B2 * | 11/2003 | Coppedge et al. | 206/511 |
| 6,742,654 | B2 * | 6/2004 | Tompkins | 206/581 |
| 6,953,118 | B2 | 10/2005 | Seno et al. | 206/764 |
| 7,070,055 | B2 * | 7/2006 | Lechanoine et al. | 206/581 |

(Continued)

FOREIGN PATENT DOCUMENTS

DE 1 797 176 4/1971

(Continued)

OTHER PUBLICATIONS

Co-pending application: Applicant: Nottingham et al., U.S. Appl. No. 29/276,346, filed Jan. 23, 2007.

(Continued)

*Primary Examiner*—Luan K Bui
(74) *Attorney, Agent, or Firm*—Fay Sharpe LLP

(57) ABSTRACT

A liquid cosmetic product retail unit includes a container and a plurality of dispensers disposed in the container. The container is dimensioned to fit onto a shelf in a retail store and includes a base, a lid and a plurality of receptacles formed in at least one of the base and the lid. A method for offering for sale a liquid cosmetic product is also disclosed.

15 Claims, 5 Drawing Sheets

U.S. PATENT DOCUMENTS

| | | | | |
|---|---|---|---|---|
| 2003/0226770 | A1 | 12/2003 | Gelardi et al. | 206/1.5 |
| 2004/0163971 | A1 | 8/2004 | Lin | 266/38 |
| 2005/0000850 | A1 | 1/2005 | Young | 206/581 |
| 2005/0145533 | A1 | 7/2005 | Seligson | 206/575 |
| 2006/0076259 | A1 | 4/2006 | Browder | 206/471 |
| 2006/0108251 | A1 | 5/2006 | Sherrer et al. | 206/459.5 |
| 2006/0231453 | A1 | 10/2006 | Grant et al. | 206/570 |

FOREIGN PATENT DOCUMENTS

| | | |
|---|---|---|
| GB | 2 307 674 | 6/1997 |
| JP | 2004 35009 | 2/2004 |

OTHER PUBLICATIONS

Co-pending application: Applicant: Nottingham et al., U.S. Appl. No. 29/276,348, filed Jan. 23, 2007.

Co-pending application: Applicant: Nottingham et al., U.S. Appl. No. 29/276,349, filed Jan. 23, 2007.

PCT International Search Report in PCT application PCT/EP2008/050570.

* cited by examiner

LIQUID COSMETIC PRODUCT RETAIL UNIT

BACKGROUND

Liquid cosmetic products, such as deodorants, antiperspirants, fragrances and the like, have been packaged in aerosol cans for many years. Typically, a large cylindrical aerosol can contains a volume of the liquid cosmetic product that is the equivalent to many applications of the product. These known aerosol cans are large in that although the can is able to fit into a medicine cabinet or similar location in a person's washroom, the can is not easily concealed in a clothing pocket or in a person's hand. This makes the application of the liquid cosmetic product noticeable by onlookers. Typically this is not a problem, since one typically applies liquid cosmetic products in the privacy of his home in either a bedroom, dressing room or bathroom.

Where one wishes to apply a liquid cosmetic product in public, the fact that the aerosol can is large and contains many applications is not particularly useful if one simply wishes to discretely apply the product. In such an instance, a small aerosol dispenser may be useful, but with the limitation in size also comes a limitation in the volume of cosmetic liquid product that the dispenser can hold.

SUMMARY

A retail unit includes a substantially cylindrical container and a plurality of dispensers disposed in the container. The substantially cylindrical container is dimensioned to fit onto a shelf in a retail store. The container includes a base, a removable lid, and a plurality of receptacles formed in at least one of the base and the lid. The lid is configured to cooperate with the base for stacking an associated container having a same configuration as the base of the container onto the lid of the container. The plurality of dispensers each containing a liquid cosmetic product are each disposed in a corresponding receptacle.

A consumer product, according to another embodiment, includes a container and a plurality of substantially cylindrical dispensers each containing a cosmetic chemical product disposed in the container. The container includes a base having a plurality of receptacles and a removable lid. Each dispenser is disposed in a corresponding receptacle. The dispensers extend above an upper edge of the container when the lid is removed.

According to another embodiment, a retail unit includes a plurality of liquid cosmetic product dispensers, a first tubular housing, and a second tubular housing. The first tubular housing has a side wall and a closed end. The side wall of the first housing at least substantially surrounds the plurality of dispensers. The first housing at the closed end contacts each of the dispensers. The second tubular housing also includes a side wall and a closed end. The side wall of the second housing at least substantially surrounds the plurality of dispensers and contacts the side wall of the first housing. The second housing at the closed end of the second housing contacts each of the dispensers.

A method of offering for sale a cosmetic chemical composition is also disclosed. The method includes displaying a first dispenser containing a cosmetic chemical composition on a retail shelf and displaying a plurality of second dispensers containing a cosmetic chemical composition on the retail shelf adjacent the first dispenser. The second dispensers are disposed in a package having a diameter that is about equal to a diameter of the first dispenser, whereby the package with the second dispensers disposed therein occupies about the same amount of retail shelf space as the first dispenser.

DETAILED DESCRIPTION

Figure 2:
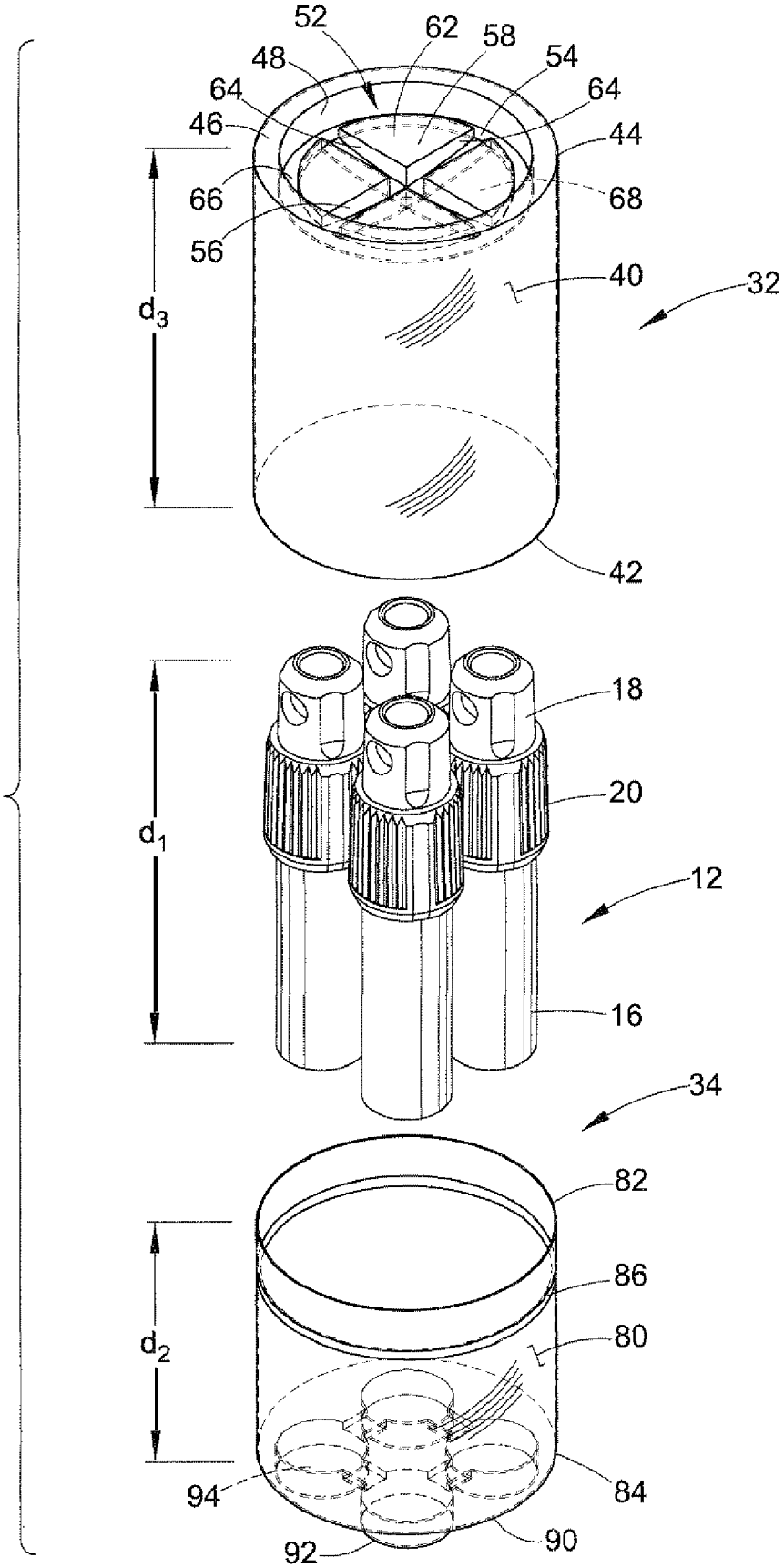
FIG. 2 is an exploded view of the unit disclosed in FIG. 1.

A retail unit 10 generally includes a plurality of dispensers 12 each containing a cosmetic liquid product and a container 14 for the dispensers. With reference to FIG. 2, each dispenser 12 includes an aerosol can 16, an actuator button 18 and a locking ring 20. The dispensers 12 contain a liquid cosmetic product, such as hairspray, body spray, deodorant, antiperspirant, fragrances including cologne and perfume, that is selectively dispensed by a user of the dispenser. In the depicted embodiment, each dispenser 12 has an internal free volume of between about 5 mL and about 15 mL. Examples of such dispensers depicted in FIG. 2 are more fully described in an application entitled "Pocket Sized Fluid Dispenser," which is assigned to the assignee of this invention and has been filed concurrently herewith. The aforementioned application is incorporated by reference herein in its entirety.

Generally, each dispenser 12 is a small capless aerosol-type dispenser that can be easily hidden in the palm of one's hand. The liquid cosmetic product can then be quickly dispensed in a discrete manner and then placed into the person's pocket. Because the dispenser does not include a cap that covers the fluid outlet of the dispenser, the locking ring 20 cooperates with the actuator button 18 so that the liquid cosmetic product is not accidentally dispensed, for example in a person's clothing pocket. The locking ring 20 rotates with respect to the can 16 between a locked position where it precludes the button 18 from moving and dispensing product to an unlocked position that allows the button to move to dispense product.

Figure 1:
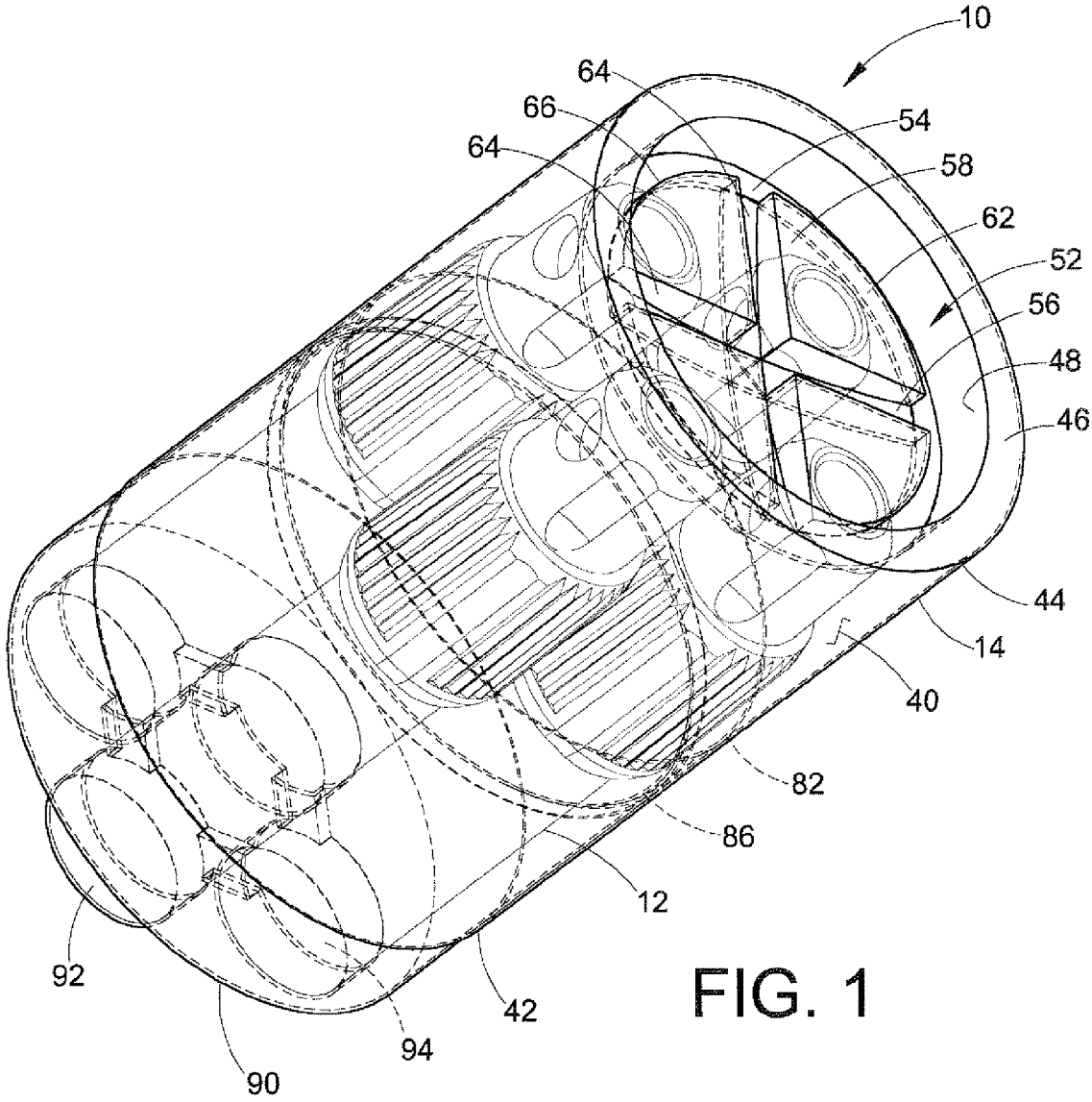
FIG. 1 is a perspective view of a retail unit including a plurality of dispensers each containing a cosmetic liquid product where the dispensers are disposed in a container.

With reference back to FIG. 1, the container 14 houses the plurality of dispensers 12. In the embodiment depicted in FIG. 1, the container 14 is generally cylindrical in configuration and is transparent. In alternative embodiments the container may have a non-cylindrical or non-circular configuration. Moreover, the container may be translucent, opaque, or opaque including a transparent window. The container 14 provides a means for conveniently providing a plurality of small, easily concealable, dispensers to a consumer in lieu of a single large dispenser that cannot be easily concealed. The dispensers 12 are arranged in the container 14 in a generally vertical orientation. A longitudinal axis of each dispenser 12, the longitudinal axis being along the dispenser's greatest dimension, is aligned generally parallel with a longitudinal axis of the container 14, the longitudinal axis being along the container's greatest dimension. Moreover, the longitudinal axis of each dispenser 12 is equidistantly radially spaced from the central axis of the container 14.

With reference back to FIG. 2, the container 14 holds the plurality of dispensers 12 and is sold along with the dispensers as part of a retail unit. The container in the depicted embodiment has a diameter of between about 40 mm and about 65 mm in one embodiment. In another embodiment, the container 14 has a diameter of between about 50 mm and about 55 mm. The container 14 generally includes an upper housing 32, which can also be referred to a lid, and a lower housing 34, which can also be referred to as a base. The lid 32 is removable from the base 34 in the depicted embodiment, the lid 32 slides over the base 34. Alternatively, the lid 32 can slide into the base. Also, the lid 32 can simply move with respect to the base 34 to provide access to the inside of the container 14.

The lid 32 includes a generally cylindrical side wall 40 that defines a lower (per the orientation depicted in FIG. 2) open end 42. The lid 32 also includes a closed end 44. An outer annular wall 46 extends radially inwardly from the cylindrical side wall 40 at the closed upper end 44 of the lid 32. A cylindrical inner wall 48 depends downwardly from the outer annular wall 46 to generally define an outer radial surface of a stacking indentation 52. An inner annular wall 54 extends radially inwardly from the circular side wall 48 and is axially spaced from the outer annular wall 46 a distance along a symmetrical axis of the container. A cross-shaped indexing indentation 56 spans the area disposed inside the inner annular wall 54 and defines a plurality (four in the depicted embodiment) of pie-shaped protrusions 58 that extend upwardly in an axial direction from the cross-shaped indexing indentation 56. Each pie-shaped protrusion is defined by a planar upper surface 62 that resides in a plane that is generally parallel to a plane in which the outer annular wall 46 resides. Each pie-shaped protrusion also includes planar side walls 64 and 66 formed by the cross-shaped indentation 56 that intersect one another at a right angle near a central axis of the container and a curved outer surface that generally follows a radius that the outer annular wall 46 follows. Each pie-shaped protrusion corresponds to a pie-shaped receptacle 68 formed in the lid 32. The receptacles and protrusions formed in the lid can take other configurations without departing from the scope of the invention.

The base 34 includes a generally cylindrical side wall 80 defining an open upper end 82. The base also includes a lower (per the orientation of FIG. 2) closed end 84. A circular indentation 86 extends inwardly toward the central axis of the container 14 and is disposed about the periphery of the cylindrical side wall 80. The indentation 86 is axially spaced from the closed end 84. The indentation 86 is used to retain a paper label pressed against the side wall 80 and inserted between the indentation and the closed end 84.

Figure 3:
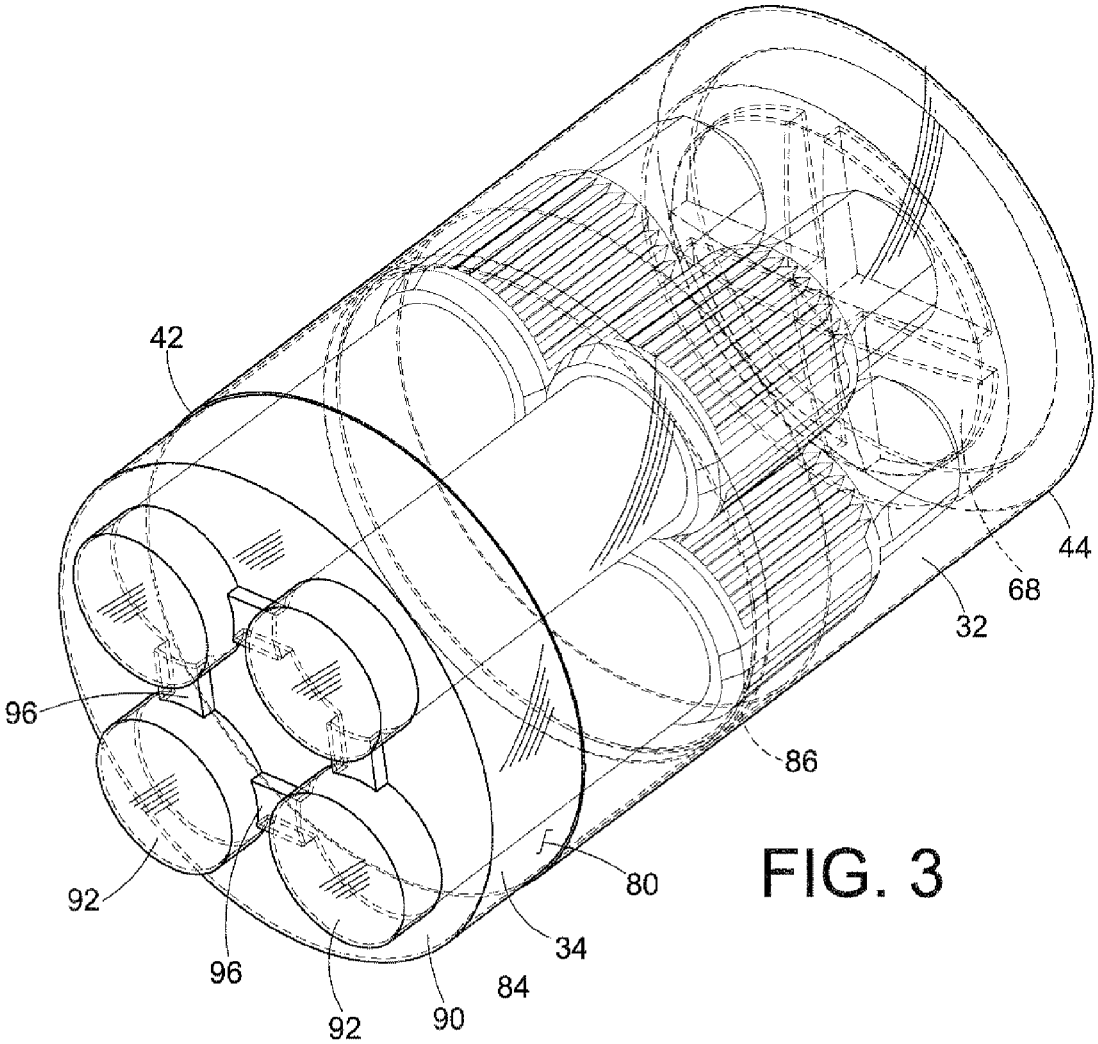
FIG. 3 is a second perspective view of the unit disclosed in FIG. 1.

With reference to FIG. 3, the base also includes a base wall 90 enclosing the closed end 84. The base wall 90 is generally circular and planar in configuration. A plurality of circular protrusions 92 extend outwardly in an axial direction from the base wall 90. Each protrusion 92 corresponds to a circular receptacle 94 formed inside the base 34. Each receptacle is configured to snugly receive a corresponding dispenser 12, e.g. via a friction fit where the receptacle maintains the dispenser in a generally vertical orientation. With reference back to FIG. 3, generally rectangular protrusions 96 also extend from the base wall 90 in the same general direction as the cylindrical protrusions 92. The generally rectangular protrusions 96 interconnect adjacent cylindrical protrusions.

With dispensers 12 packaged in the container 10, the assembly comprises a compact retail unit that can be displayed on a retail shelf. Four dispensers 12 are shown in the retail unit 10, but a fewer or greater number can be provided. The dispensers 12 are packaged so that a lower end of each dispenser contacts the base 34 of the container by being received in a corresponding lower receptacle 94 and also contacts the lid 32 of the container by being received in a corresponding upper receptacle 68. The cross-shaped indentation 56 that defines the upper receptacles 68 inhibits the actuator buttons 18 from contacting one another during shipment of the retail unit. Also, when the container is shrink wrapped or the lid 32 is adhered to or held in place with respect to the base 34, the dispensers 12 are contained axially with respect to the container. Accordingly, the retail unit can also include a shrink wrap at least partially surrounding the container 14.

The dimensions of the container 14 and the dispensers 12 are such that the dispensers can be easily removed from and nicely held in the base 34 after the lid 32 has been removed. The receptacles 94 in the base 34 are configured to snugly receive each dispenser so that the dispensers maintain a generally vertical orientation when disposed in a respective receptacle. The dispensers have a height $d_1$ that is greater than a height $d_2$ of the base 34 of the container. Accordingly, a portion of each dispenser 12 extends above the open end 82 of the base 34 when the lid 32 has been removed so that the dispensers can be easily removed from the base when the lid has been removed from the base. This provides a useful means for storing the dispensers in a medicine cabinet or the like without the need for the lid 32.

The lid 32 has a height $d_3$ that is greater than $d_2$ and less than $d_1$. As more clearly seen in FIG. 1, the lid 32 is configured to be received over the base 34 such that the cylindrical side wall 40 of the lid contacts the cylindrical side wall 80 of the base. This allows the side walls 40 and 80 to reinforce one another which allows the container to be made from a thin plastic material reducing its weight and cost as well as the amount of material required to make the container thus reducing the environmental impact.

Figure 4:
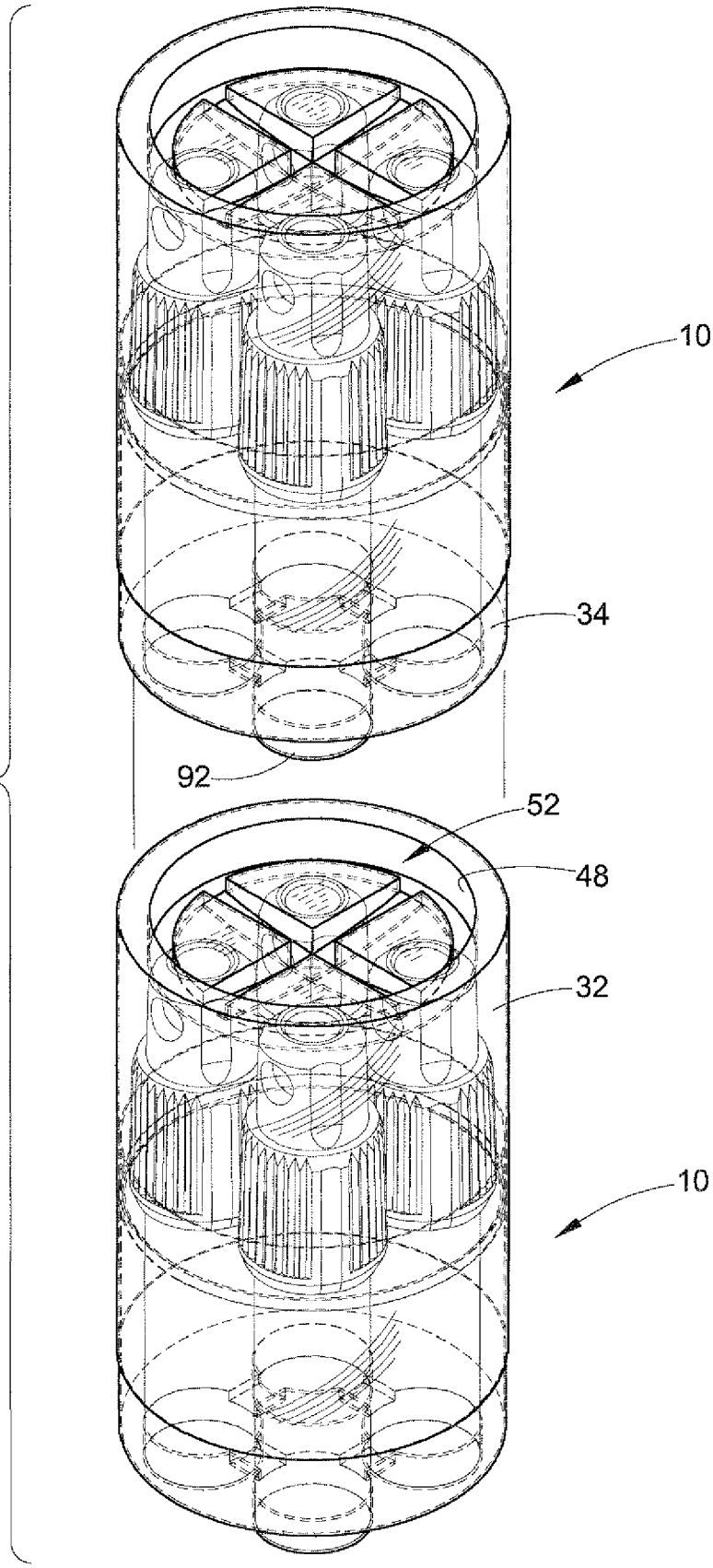
FIG. 4 is a perspective view of the retail unit depicted in FIG. 1 prior to nesting onto another similar retail unit.
Figure 5:
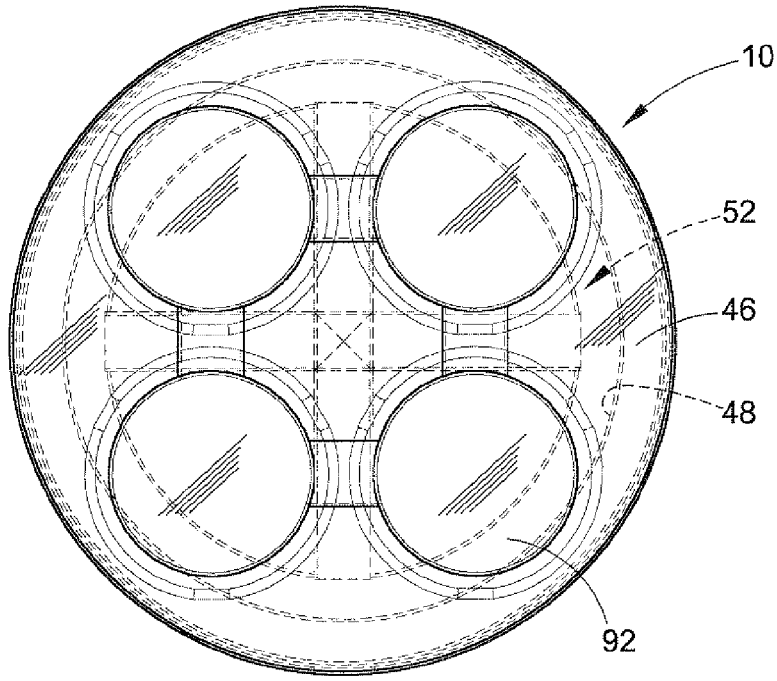
FIG. 5 is a bottom plan view of the unit depicted in FIG. 1.

The containers 14 that hold the dispensers 12 are also configured to allow for vertical stacking and nesting of the retail units 10. With reference to FIG. 4, two retail units 10 are disclosed that are about to be stacked and nested upon one another. The stacking indentation 52 in the lid 32 of the lower container (as per the orientation in FIG. 4) is configured to receive the protrusions 92 that extend downwardly from the base 34 of the upper container (as per the orientation in FIG. 4). With reference to FIG. 5, which shows a bottom plan view of the retail unit 10, the protrusions 92 are circumscribed by a circle having a diameter that is slightly larger than the indentation 52 in the lid so that the protrusions fit snugly into the indentation of a lid of the container disposed beneath it. In other words, a segment of each protrusion 92 contacts a respective segment of the cylindrical side wall 48 that defines the stacking indentation 52 of the container beneath it.

Figure 6:
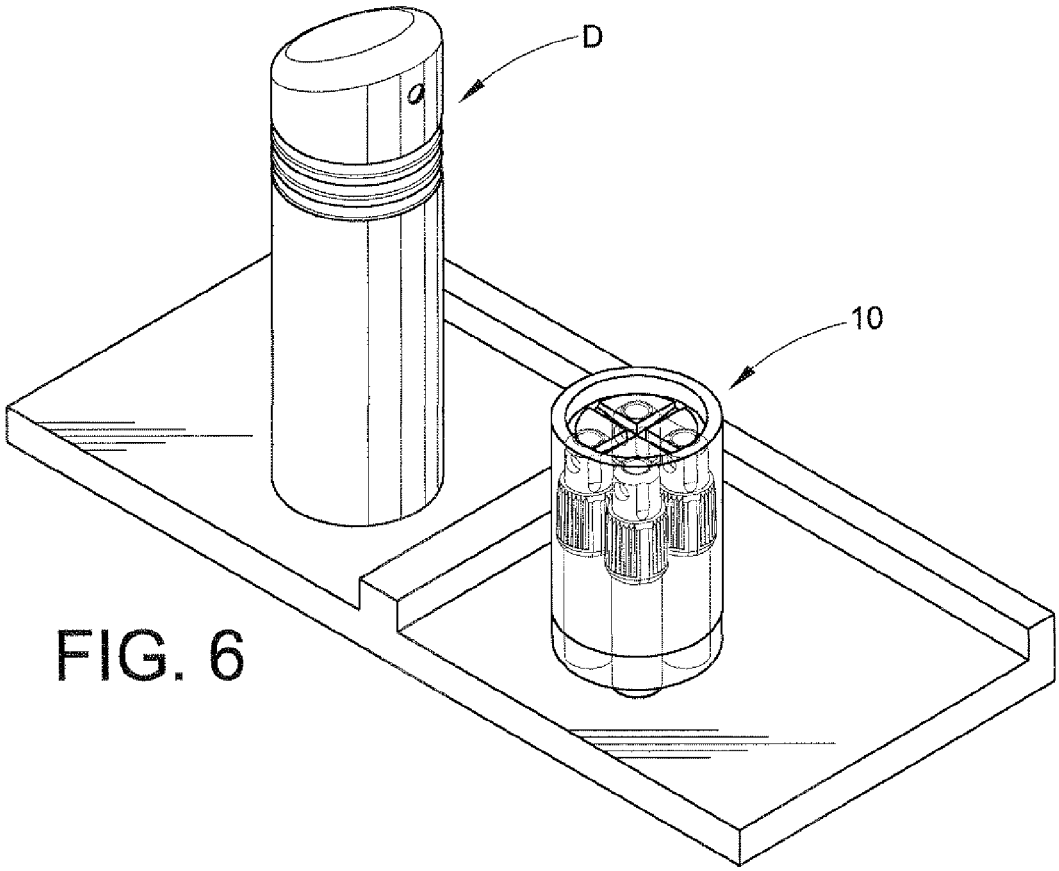
FIG. 6 is a view of the retail unit depicted in FIG. 1 placed next to a known larger cosmetic liquid product dispenser.

With reference to FIG. 6, the retail unit 10 including the plurality of dispensers each containing a liquid cosmetic product can be sold side by side with a larger dispenser D also containing the same or similar liquid cosmetic product. The diameter of the container holding the dispensers 12 can have the same or very similar diameter to the larger dispenser D so that the retail unit 10 having the plurality of dispensers occupies the same amount of retail shelf space as the larger dispenser. The dispensers 12 that are placed in the container are vertically oriented, as is the larger dispenser D. If desired, the containers 14 that are containing the plurality of dispensers 12 can also be vertically stacked and/or nested on top of one another on the retail shelf. Alternatively, the containers having the plurality of dispensers can simply be nested when being shipped to the retailer and then removed from the nesting configuration prior to being displayed on the retail shelf.

A retail unit including a plurality of dispensers each containing a liquid cosmetic product has been described in detail. Modifications and alterations to the depicted embodiment will occur to those upon reading and understanding of the detailed description. The invention is not limited to only those embodiments that have been shown and/or described. Instead, the invention is broadly defined by the appended claims.

The invention claimed is:

1. A retail unit comprising:

a substantially cylindrical container dimensioned to fit onto a shelf in a retail store, the container including a base, a removable lid, and a plurality of receptacles formed in at least one of the base and the lid, the lid being configured to cooperate with the base for stacking an associated container having a same configuration as the base of the container onto the lid of the container, wherein the plurality of receptacles are formed in the base and each correspond to a protrusion extending from the base, wherein the lid includes an indentation for receiving the protrusions extending from the base, and wherein the protrusions are circumscribed by a circle having a diameter that is slightly larger than the indentation whereby the protrusions snugly fit into the indentation; and a plurality of liquid cosmetic product aerosol dispensers each disposed in a corresponding receptacle.

2. The unit of claim 1, wherein the lid further includes a plurality of receptacles each generally aligned with a corresponding receptacle in the base.

3. The unit of claim 2, wherein the receptacles in the lid are defined by a cross-shaped indexing indentation.

4. The unit of claim 1, wherein the plurality of receptacles are formed in both the base and the lid.

5. The unit of claim 1, wherein at least one of the base and the lid is transparent.

6. The unit of claim 1, wherein at least one of the base and the lid includes a transparent window.

7. The unit of claim 1, wherein the lid slides onto or into the base.

8. A retail unit comprising:

a plurality of body spray dispensers;

a first tubular housing having a side wall, and a first closed end, the side wall of the first housing at least substantially surrounding the plurality of body spray dispensers, and the first tubular housing contacting each of the dispensers at the first closed end; and a second tubular housing having a side wall and a second closed end, the side wall of the second housing at least substantially surrounding the plurality of body spray dispensers and contacting the side wall of the first housing, and the second tubular housing contacting each of the dispensers at the second closed end;

wherein the first tubular housing includes a first plurality of receptacles formed at the first closed end each radially inwardly offset from the side wall of the first tubular housing, and the second tubular housing includes a second plurality of receptacles formed at the second closed end each radially inwardly offset from the side wall of the second tubular housing, wherein each first receptacle and each second receptacle receive a respective dispenser.

9. The retail unit of claim 8, further comprising shrink wrap surrounding at least a portion of the first housing and the second housing for attaching the housings together.

10. The retail unit of claim 8, wherein each dispenser is received in at least one of the first plurality of receptacles and at least one of the second plurality of receptacles via a friction fit, and each dispenser is radially inwardly offset from the side wall of the first tubular housing and is radially inwardly offset from the side wall of the second tubular housing.

11. The retail unit of claim 10, wherein the first housing includes a stacking indentation and an indexing indentation defining the first plurality receptacles, wherein the second housing includes a plurality of protrusions, each second receptacle corresponding to a respective protrusion, wherein the stacking indentation is configured to receive the protrusions from an associated second housing having a same configuration as the second housing.

12. A retail unit comprising:

a plurality of aerosol dispensers each including an actuator button;

a base including a base wall, a plurality of lower receptacles extending outwardly in an axial direction from the base wall, and a plurality of downwardly extending protrusions, each lower receptacle receiving a respective dispenser and corresponding to a respective protrusion; and a removable lid slidable onto or into the base, the lid including a stacking indentation and an indexing indentation defining upper receptacles, the dispensers contacting the lid and being received in a corresponding upper receptacle, wherein the indexing indentation inhibits the actuator buttons from contacting one another during shipment of the retail unit, wherein the stacking indentation is configured to receive the protrusions from an associated base having a same configuration as the base.

13. The retail unit of claim 12, wherein the indexing indentation is cross-shaped.

14. The retail unit of claim 12, wherein each lower receptacle receives a respective dispenser via a friction fit.

15. The retail unit of claim 12, wherein each lower receptacle is circular.

* * * * *